United States Patent [19]

Letourneau

[11] Patent Number: 4,978,085

[45] Date of Patent: Dec. 18, 1990

[54] WIRE-DISPENSING SPOOL AND CASING

[76] Inventor: Bernard Letourneau, 1365, du Palais Avenue, St-Joseph de Beauce, Canada, G0S 2V0

[21] Appl. No.: 440,746

[22] Filed: Nov. 24, 1989

[51] Int. Cl.[5] ..... B65H 16/00

[52] U.S. Cl. ..... 242/85

[58] Field of Search ..... 242/85, 137, 137.1, 242/138, 139, 140, 68.7, 78.7, 129, 86.2, 86.3, 86.6, 86.61, 86.62, 71.8, 116, 117, 55.3

[56] References Cited

U.S. PATENT DOCUMENTS

| | | | |
|---|---|---|---|
| Re. 24,560 | 11/1958 | Moulden | 242/137.1 |
| 1,474,580 | 11/1923 | Clark et al. | 242/137.1 |
| 1,826,084 | 10/1931 | Mohr | 242/137.1 |
| 2,178,212 | 10/1939 | Schellenger . | |
| 2,268,547 | 1/1942 | Haines . | |
| 2,947,492 | 8/1960 | Sarka | 242/78.7 |
| 2,991,958 | 7/1961 | Eifrid . | |
| 3,027,003 | 3/1962 | Cole et al. | 242/137.1 |
| 3,103,322 | 9/1963 | Garner | 242/68.7 |
| 3,198,449 | 8/1965 | Scher | 242/68.7 |
| 3,212,729 | 10/1965 | Putnam . | |
| 3,214,113 | 10/1965 | Murray et al. . | |
| 4,431,144 | 2/1984 | Foster | 242/85 |
| 4,592,518 | 6/1986 | Chubb et al. | 242/78.7 |
| 4,768,290 | 9/1988 | Cooper | 33/139 |
| 4,804,152 | 2/1989 | Masuda | 242/68.7 X |

FOREIGN PATENT DOCUMENTS

| | | |
|---|---|---|
| 691515 | 7/1964 | Canada . |

*Primary Examiner*—Daniel P. Stodola
*Assistant Examiner*—John P. Darling

[57] ABSTRACT

A dispenser for stiff resilient wire such as guy wire is disclosed. It comprises a box-shape casing having an upwardly rearwardly opening diagonal cover and a spool rotatably removably mounted therein on three corner-mounted transverse rollers in the casing and one transverse roller in the cover. The casing has a lower front slot through which the wire is paid out. The casing and spool arrangement allows easy rewinding of the wire. The spool is formed of two separable half-sections for ready installation of a coil or wire. A plurality of casings may be placed side by side and loaded or unloaded without displacement.

12 Claims, 3 Drawing Sheets

WIRE-DISPENSING SPOOL AND CASING

FIELD OF THE INVENTION

The present invention relates generally to a wire dispensing apparatus, more specifically to a casing having spool means adapted to be reeled out and rewound with resilient wire.

BACKGROUND OF THE INVENTION

Heavy duty wire such as guy wire is used to maintain and stabilize utility poles and towers. Such a wire, including heavy electrical wire, is usually extremely resilient or stiff. Such wire is usually tranported or shipped into a coil, the latter being dispensed in a suitable device or apparatus such as a rotatable spool inside a casing. For example the U.S. Pat. No. 2,268,547 to Haines issued on Jan. 6, 1942 discloses a spool and casing which dispenses wire without snarling or kinking. The problem with such apparatus is that it is impossible to rewind an unused length of wire because the wire will expand radially within the casing until the pressure exerted on the interior surface of the casing stops the spool from rotating. Such an apparatus therefore has a limited use potential.

OBJECTS OF THE INVENTION

In view of the above it is a first object of the invention to provide a spool and a casing adapted to make possible heavy gauge wire rewinding.

It is another object of the invention to provide a spool and casing of the above type wherein it is very easy to place or remove a spool in or from the casing.

It is yet another object of the present invention to provide a casing of the above type which may be placed side by side with a plurality of other identical casings each of which may be loaded and unloaded without displacement or dismantling.

SUMMARY OF THE INVENTION

The above and other objects of the invention are realized according to a preferred embodiment comprising a generally box-shaped casing and a spool rotatably and removably mounted therein.

The casing is formed of a bottom, side walls, a front wall portion, a rear wall and a top wall portion. Pivotally secured to the latter is a diagonal cover adapted to open upwardly and rearwardly.

Releasable lock means are provided to lock the cover in closed portion.

A handle is preferably secured to the cover to facilitate its opening and closing.

When the cover is in closed position the casing and cover define four corners; mounted in each of these corners is a rotatable transverse roller member. One of the rollers is thus mounted in the cover. The rollers are approximately situated at the extremities of an X configuration when viewed from a side. A spool contemplated by the invention comprises two similar half-sections adapted to be detachably joined together. Each spool half-section has a drum portion and a preferably integrally-formed outer annular flange. Joining means are provided to secure the sections together after a coil of wire has been placed around the drum portion of the sections. Means to positively prevent any relative movement of the two half-sections are further provided.

A lowermost slot is provided at the lower end of the front wall portion through which exits the cable or wire of the coil.

After the spool is placed in position in the casing the flanges engage the roller members, rotating in contact therewith.

The wire is paid out under the lower front roller, exteriorly of the latter, and interiorly of the other three roller members since the flanges have a greater diameter than the drum.

When it is desired to rewind wire the task is easy because the above arrangement prevents any radial expansion of the coil in the casing.

BRIEF DESCRIPTION OF THE DRAWINGS

The above will be more clearly understood by having referral to a preferred embodiment of the invention, illustrated by way of the accompanying drawings, in which:

FIG. 4*a* is a cross-section similar to FIG. 4 but showing another embodiment in which a single casing contains three spools;

Like numerals indicate like elements throughout the drawings.

DETAILED DESCRIPTION OF THE PREFERRED EMBODIMENTS

Figures 1, 2, 5:
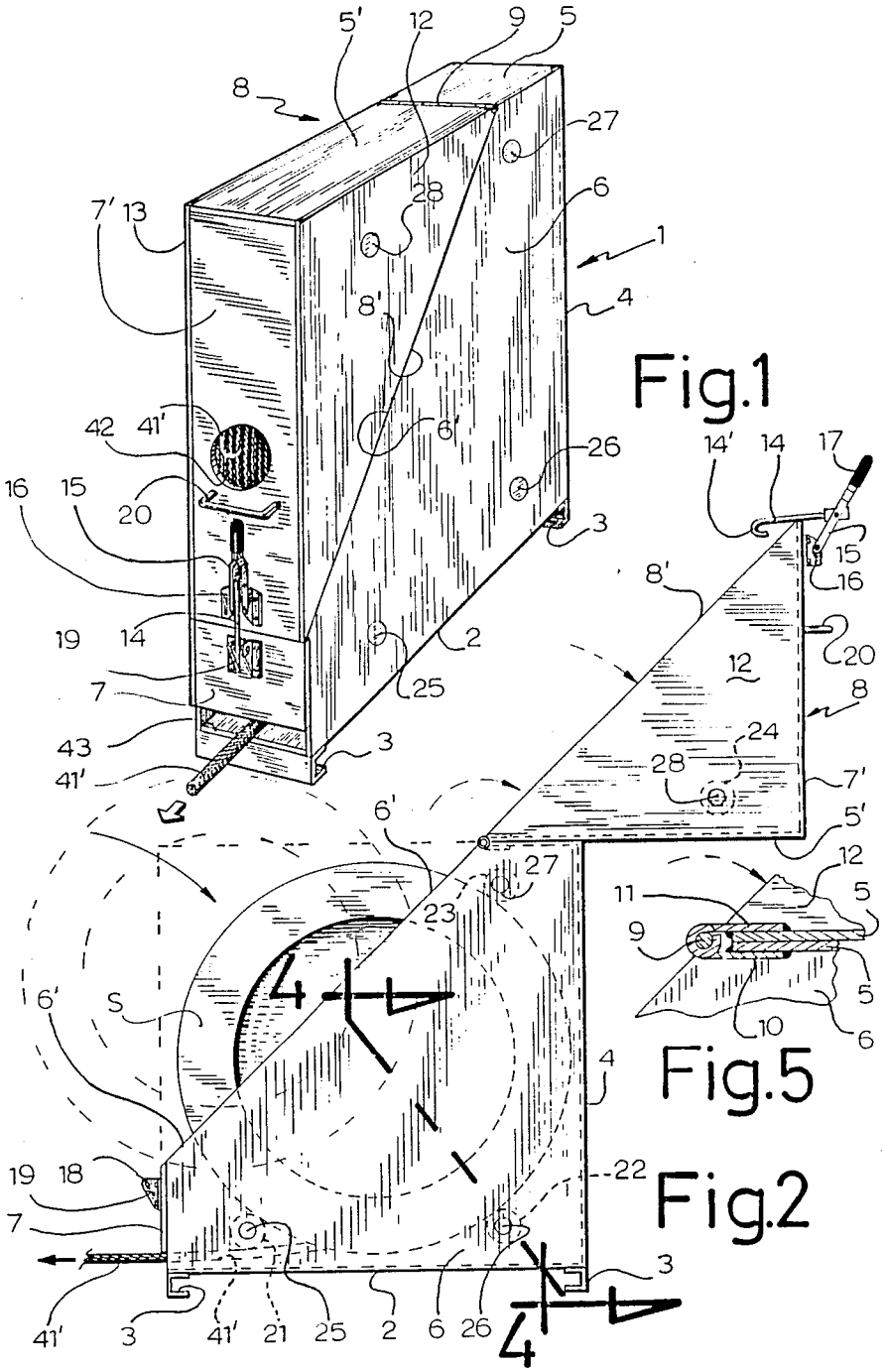
FIG. 1 is a perspective view of a casing containing a spool, also showing a portion of guy wire.
FIG. 2 is a right side elevation of a casing as in FIG. 1 but showing the cover in open loading condition also showing a spool in position in the casing, further showing, in dashed outline how a spool is loaded.
FIG. 5 is an enlarged detail view, partially sectioned, of the pivot means of the casing cover.

FIG. 1 shows a casing, designated at 1, according to the invention. Casing 1 includes a bottom 2 supported at its front and rear by floor-contacting cross-sectionally U-shaped bars 3; a rear wall 4 (shown in FIG. 2), a pair of opposite side walls 6, a top wall portion 5 and a front wall portion 7.

Casing 1 is adapted to be closed by a cover 8. Cover 8 has a generally triangular shape and has diagonally extending edges 8' defined by side walls 12, 13. The angle of inclination is preferably forty five degrees thereby forming the major portions of the front and top walls at 7' and 5' respectively. Edges 8' contact the similarly inclined tops edges 6' of casing side walls 6. The meeting edges of top portion 5 and top wall 5' are provided with a pivot means consisting of a piano hinge 9 having a pair of transverse flanges 10, 11 secured as by welding to the top portion 5 and top wall 5', respectively ( as clearly shown in FIG. 5).

To maintain cover 8 in closed position, a lock means is provided. The lock consists of a hook member 14 and a toggle handle 15. As shown in FIG. 1 and FIG. 2, toggle 15 is formed with two arms which are each pivotally secured to a double-lug bracket 16 at one end and which merge into a handle portion 17 at its opposite end. Hook member 14 is pivotally secured to toggle 15 at the middle of the latter and has a hook 14' at its opposite end. Hook 14' is adapted to releasably catch a transverse pin 18 mounted in another double-lug bracket 19 secured to front wall portion 7. Hook member 14 extends between the two arms of toggle 15 when in locked position.

A handle 20 is provided above the lock means so that cover 8 may be easily lifted.

Figure 4:
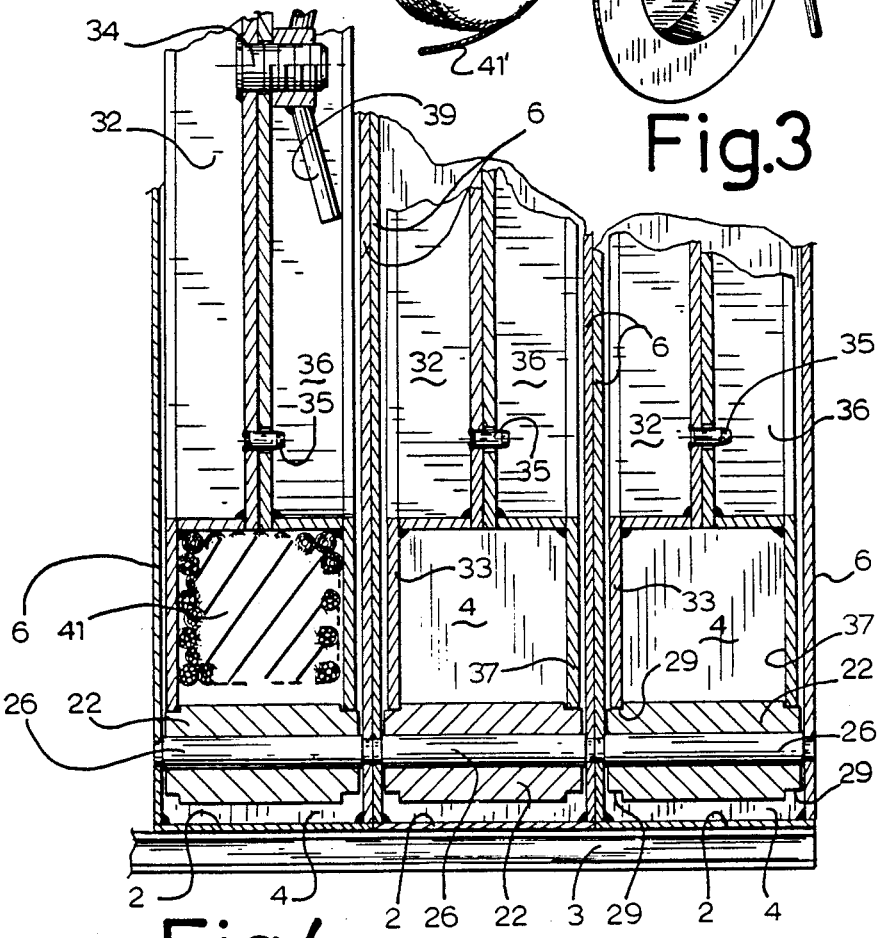
FIG. 4 is a cross-sectioned view taken along lines 4—4 of FIG. 2, but showing three casings and spools disposed side by side.

FIGS. 2 and 4 illustrate an essential feature of the invention: roller members 21, 22, 23, and 24. Each roller is rotatably mounted on a shaft 25, 26, 27, and 28 respectively, each of the latter being riveted or welded into holes made in the two side walls of the casing, with the exception of roller 24 and shaft 28 which are mounted in cover 8. When the cover is closed the four rollers are disposed at the four corner extremities of the casing in an X-like configuration.

Preferably, as shown in FIG. 4, both ends of each roller member are formed with a circular groove as shown at 29 (FIG. 4).

Figure 3:
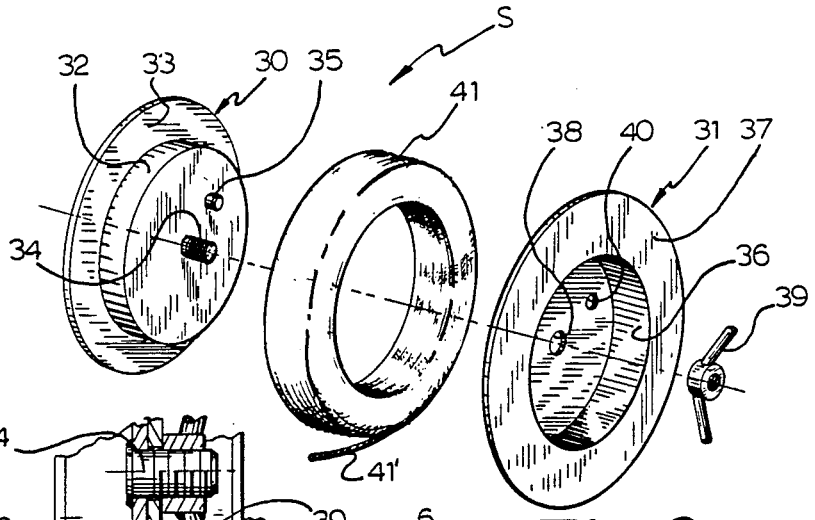
FIG. 3 is an exploded perspective view of the spool sections according to the invention and a coil of wire therebetween.

Referring now to FIG. 3 there is shown a preferred embodiment of a spool S according to the invention. The spool is made of two similar half-sections 30 and 31. Section 30 is formed with a drum section 32 having a flat inner face, and an integrally formed outer annular flange 33. Rigidly secured to the center of the flat face is a short threaded rod 34. Also secured to the flat face and projecting away therefrom is a pin element 35 radially spaced from rod 34. Half-section 31 is of the same dimensions, being formed of another drum section 36 having a complementary flat inner face, and an outer annular flange 37. Section 31 has a central hole 38 through which may pass rod 34. A wing nut 39 is screwable on rod 34 to secure the two half-sections together. It will be clear that rod 34, hole 38 and wing nut 39 constitute the joining means disclosed above. A second smaller hole 40 is provided in the face of section 31 in registry with pin 35. Thus such anti-movement means effectively eliminates any relative rotation of the two half-sections 30, 31 when the latter are assembled.

FIG. 3 further shows a coil of high resilient wire 41. It is readily understood how the coil is loaded onto the spool half-sections which are then assembled.

The coil on the spool can be simply put into the casing by lifting it either manually or mechanically onto the top edge of front wall portion 7 and rolling it from there into position on the rollers as shown in FIG. 2. Such loading and unloading would be impossible if the cover and casing were not diagonally inclined. Of course the length of the diagonal opening is slightly more than the diameter of the spool annular flanges 33 and 37.

FIG. 4 shows flanges 33, 37 engaging grooves 29 of the rollers 21, 22 to guide the spools S against shifting laterally of the casing.

FIG. 4 shows that a plurality of casings may put side by side, mounted on transversely elongated base members 3, the left hand casing containing a coil of wire 41. Thus different gauges of wires can be conventionally located together in the lined-up casings. Obviously a single casing could be provided to house at least two spools S side by side with partitions for supporting the roller shafts 25, 26, 27 and 28. Such an arrangement is shown in FIG. 4*a*. Three spools S are mounted side by side in a common casing including a bottom 2*a*, side walls 6 and a rear wall 4*a*. The cover, not shown, obviously fits the casing. Partitions 6*a*, fixed to bottom 2*a* and to the top walls of the common casing and of its common cover, support roller shafts 25, 26, 27 and 28. Each roller shaft may be common to the three rollers it supports. Referring again to FIG. 2 there is shown the manner of unwinding wire 41' from coil 41. The strand 41' passes through a lower slot 43, under or outerly of the lower front roller 21 and inwardly of the other three rollers. Thus when it is desired to rewind the wire the latter will slide against rollers 22, 23 and 24 without frictionally contacting the interior surfaces of the casing and its cover.

Front wall 7' is preferably provided with a large circular aperture 42 in order to allow a workman to determine how much of wire 41' remains on spool S.

In the case of a casing housing two or more spools (FIG. 4*a*) an aperture 42 and a pay out slot 43 are provided in register with each spool S.

What I claim:

1. A casing and spool for dispensing resilient wire, comprising a casing portion including a bottom, two opposite side walls each having an upwardly, rearwardly inclined top edge, a rear wall, a front wall portion, a top wall portion a diagonally-oriented cover pivoted to said casing portion and openable upwardly rearwardly of said casing portion; pivot means to open and close said cover; said casing portion and said cover defining a box-shaped casing with four corners when said cover is in closed position; four transverse roller means mounted in said casing, one in each of the three casing portion corners and one in the cover corner; said spool being formed of two half-sections each having a drum portion having a flat inner face and an outer annular flange rollingly engageable with said roller means in said casing; means to detachably join said two spool half-sections together; anti-movements means to prevent relative movement of the two spool half-sections; said spool being adapted to be loaded with a coil of said resilient wire; said front wall portion being provided with a lower slot through which said wire may pass whereby said wire may be easily unwound from and rewound in said casing.

2. A casing and spool as defined in claim 1, wherein releasable lock means are provided to lock said cover in closed position.

3. A casing and spool as defined in claim 2, wherein said pivot means consists of a hinge fixed to a pair of transverse flanges; one of the latter being secured to said top wall portion and the other said flange being secured to the top wall of said cover.

4. A casing and spool as defined in claim 2, wherein the front wall of the casing is provided with a handle.

5. A casing and spool as defined in claim 4, wherein said lock means consists of a toggle lever pivotally secured to said front wall of said casing cover, a hook member pivotally secured to the middle of said toggle lever and having a hook at its opposite end; a transverse pin secured to said front wall portion of said casing; said hook member adapted to releasably catch said transverse pin when said toggle lever is in locked position.

6. A casing and spool as defined in claim 5, wherein said front wall of said cover is provided with a large aperture for viewing said coil in the interior of said casing.

7. A casing and spool as defined in claim 6, wherein said means to join said spool half sections together consist of a central threaded stud secured to said drum portion inner face of one section; a corresponding hole made in the center of the said drum portion inner face of the other section, and a wing nut adapted to be threaded onto said stud.

8. A casing and spool as defined in claim 7, wherein said anti-movement means for said spool half-sections consists of a locking pin radially spaced away from said stud and projecting from said one section, and a corresponding hole made in said other section.

9. A casing and spool as defined in claim 1, wherein each said roller means includes a roller member rotatably mounted on a transverse shaft fixed to said side walls of said casing, one of said shafts being fixed to said cover.

10. A casing and spool as defined in claim 1, wherein said side walls are entirely flat, whereby a plurality of said casings can be located side by side.

11. A casing and spool as defined in claim 1, wherein a plurality of said spools are rollingly supported and retained by said roller means in side by side relation in said casing.

12. A casing and spool as defined in claim 1, further including guide means carried by at least the roller means located at the two lower corners of said casing for engaging said flanges of said spool.

* * * * *